US007614456B2

(12) United States Patent
Twum

(10) Patent No.: US 7,614,456 B2
(45) Date of Patent: Nov. 10, 2009

(54) FIRE RETARDANT DELIVERY SYSTEM FOR FIGHTING WILD FIRES

(76) Inventor: Thomas Twum, 609 Willow St., Lakehurst, NJ (US) 08733

( * ) Notice: Subject to any disclaimer, the term of this patent is extended or adjusted under 35 U.S.C. 154(b) by 211 days.

(21) Appl. No.: 11/711,919

(22) Filed: Feb. 28, 2007

(65) Prior Publication Data

US 2008/0202772 A1 Aug. 28, 2008

(51) Int. Cl.
*A62C 8/00* (2006.01)

(52) U.S. Cl. ..... 169/36; 169/30; 169/34; 169/53; 169/70; 239/302; 239/309

(58) Field of Classification Search ..... 169/30, 169/36, 53, 70, 34; 239/302, 309, 171
See application file for complete search history.

(56) References Cited

U.S. PATENT DOCUMENTS

| | | | | | |
|---|---|---|---|---|---|
| 324,577 | A * | 8/1885 | Mitchell | ..... | 169/36 |
| 1,458,972 | A * | 6/1923 | Braude | ..... | 169/36 |
| 2,359,573 | A * | 10/1944 | Mackay | ..... | 169/36 |
| 2,515,832 | A * | 7/1950 | Mournaud | ..... | 169/36 |
| 6,474,564 | B2 * | 11/2002 | Doshay et al. | ..... | 169/36 |

* cited by examiner

*Primary Examiner*—Steven J Ganey
(74) *Attorney, Agent, or Firm*—Clifford G. Frayne

(57) ABSTRACT

A flexible, frangible bladder for the receipt of water and/or fire retardant, the bladder of sufficient size to contain a sufficient amount of such water and/or fire retardant, the bladder being positionable in a retaining member positioned on an aircraft, the retaining member selectively moveable so as to release the bladder onto a desired location in a wild fire, the bladder bursting upon impact, and spreading the water and/or fire retardant.

5 Claims, 3 Drawing Sheets

FIRE RETARDANT DELIVERY SYSTEM FOR FIGHTING WILD FIRES

BACKGROUND OF THE INVENTION

1. Field of the Invention

The present invention relates to fire fighting, and in particular, to a delivery system for delivering water or other fire retardants onto a wild fire to insure that the water or fire retardants are delivered to the desired location.

2. Description of the Prior Art

Fire fighting in urban and suburban areas is usually accomplished by a plurality of fire trucks having access to a water supply system which allows the fire trucks to deliver a desired quantity of water onto the fire as desired. In some occasions because of the nature of the fire, the fire trucks utilize fire retardants other than water, such as foam and/or powders to extinguish the fires. The advantage in urban and suburban areas is the availability of the plurality of fire trucks and the availability of a supply system, e.g. hydrants for supplying the water.

Wild fires normally occur in extremely rural or wilderness areas which makes it difficult to marshal a plurality of fire trucks in order to fight the blaze, and the situation is further complicated in that there is not normally a water supply system in place in extremely rural or wilderness areas where fire trucks, if available, would have access to a quantity of water necessary to extinguish the blaze. Therefore the fire-fighting of wild fires in rural and wilderness areas requires a different strategy from that of urban and suburban areas.

Typically, wilderness wild fires are fought by means of attempting to deny the wild fire further kindling so as to extend its area. Fire fighters cut fire breaks to remove the source of kindling and/or start back fires so as to burn kindling in an area before the wild fire reaches that area.

The use of water in fighting wild fires is limited, unless there is a source of water nearby such as a stream or lake in which a fire pumper could position a hose and pump and pump water to the fire. In most instances the delivery of water or a fire retardant to a wild fire is accomplished by a helicopter carrying a bladder of water or a water tanker airplane designed to carry water or fire retardant.

The deficiency in these two delivery systems is that the helicopter or the plane must fly significantly higher than the flames, smoke and heat generated by the wild fire and that the water and/or fire retardant released from the bladder suspended from the helicopter or from the water tanker is subject to the vagaries of the wind conditions and the heat of the fire. In many instances the water or fire retardant will not hit the designated target but will be shifted by the wind and depending upon the ferocity of the fire, any water so dropped may in effect evaporate before it hits the ground and can perform its intended task.

There is therefore a need for a system and apparatus which can accurately deliver water or fire retardant to a designated spot in a wild fire situation and which apparatus can be economically fabricated, economically filled, and economically loaded onto a particular aircraft for delivery and which insures that the water or fire retardant contained therein is not evaporated or effected before it reaches its intended destination.

OBJECTS OF THE INVENTION

An object of the present invention is to provide for a novel apparatus and method for effectively delivering water and/or fire retardant to a designated location in fighting a wild fire.

A still further object of the present invention is to provide for a novel apparatus and method of filling, transporting and delivering water and/or fire retardant to a designated location in a wild fire.

A still further object of the present invention is to provide for a novel apparatus and method for delivering water and/or fire retardant to a designated location in a wild fire in which the apparatus is economically fabricated, economically transported, and economically delivered.

SUMMARY OF THE INVENTION

A flexible, frangible bladder for the receipt of water and/or fire retardant, the bladder of sufficient size to contain a sufficient amount of such water and/or fire retardant, the bladder being positionable in a retaining member positioned on an aircraft, the retaining member selectively moveable so as to release the bladder onto a desired location in a wild fire, the bladder bursting upon impact, and spreading the water and/or fire retardant.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
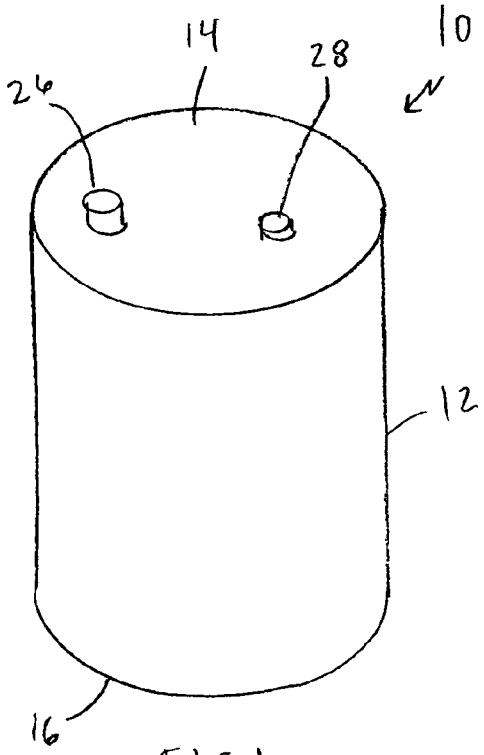
FIG. 1 is a perspective view of a flexible frangible bladder of the present invention.
Figure 2:
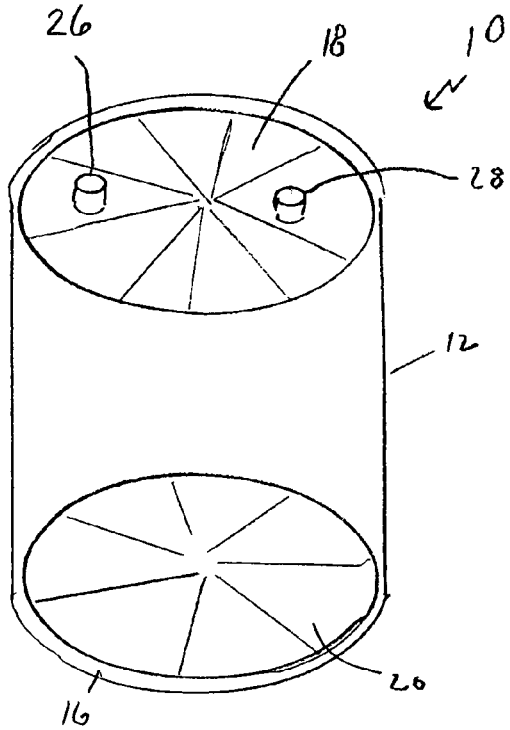
FIG. 2 is a perspective cutaway view of a flexible, frangible bladder of the present invention.

FIG. 1 is a perspective view of a flexible, frangible bladder 10 of the present invention designed to contain water or other suitable fire retardant, and FIG. 2 is a perspective cutaway view of the bladder designed to contain water or fire retardant. The bladder 10 in this embodiment is generally cylindrical in nature having a cylindrical side wall 12, an outer top wall 14, and an outer bottom wall 16. In the preferred embodiment, an inner top wall 18 and inner bottom wall 20 would be composed of interior semi-rigid, segmented walls in order to provide cylindrical integrity to the bladder. This cylindrical side wall 12 and the overlying outer top wall 14 and outer bottom wall 16 would be comprised of a flexible, frangible fabric such as plastic and/or aluminum foil. The inner top and inner bottom walls 18 and 20 would be formed of a frangible circular member such as cardboard, thin gauge aluminum, or equivalent which would ensure the frangibility of the bladder.

The bladder 10 in this embodiment, when unfilled with water or other suitable fire retardant would have a collapsed irregular shape, but when filled with water or suitable fire retardant, would take on the shape of a cylinder.

The inner top wall 18 of bladder 10 would be fitted with a filling connection 26 in order to introduce the water or other fire retardant into the bladder 10. A bleed connection 28 can also be formed in the inner top wall 18 to aid in the evacuation of air from the bladder 10 while being filled and which would reduce the time requirement for filling the bladder. The outer top wall 14 would be secured and sealed about these connections.

The bladder 10 as described is constructed of very inexpensive materials and obtains its shape and integrity by being filled with water or other suitable fire retardant. The materials chosen for the construction of the bladder are frangible in that it is the desire that the bladder burst upon impact with the ground thereby spreading the contained water and/or fire retardant on the desired location in a wild fire.

Figure 3:
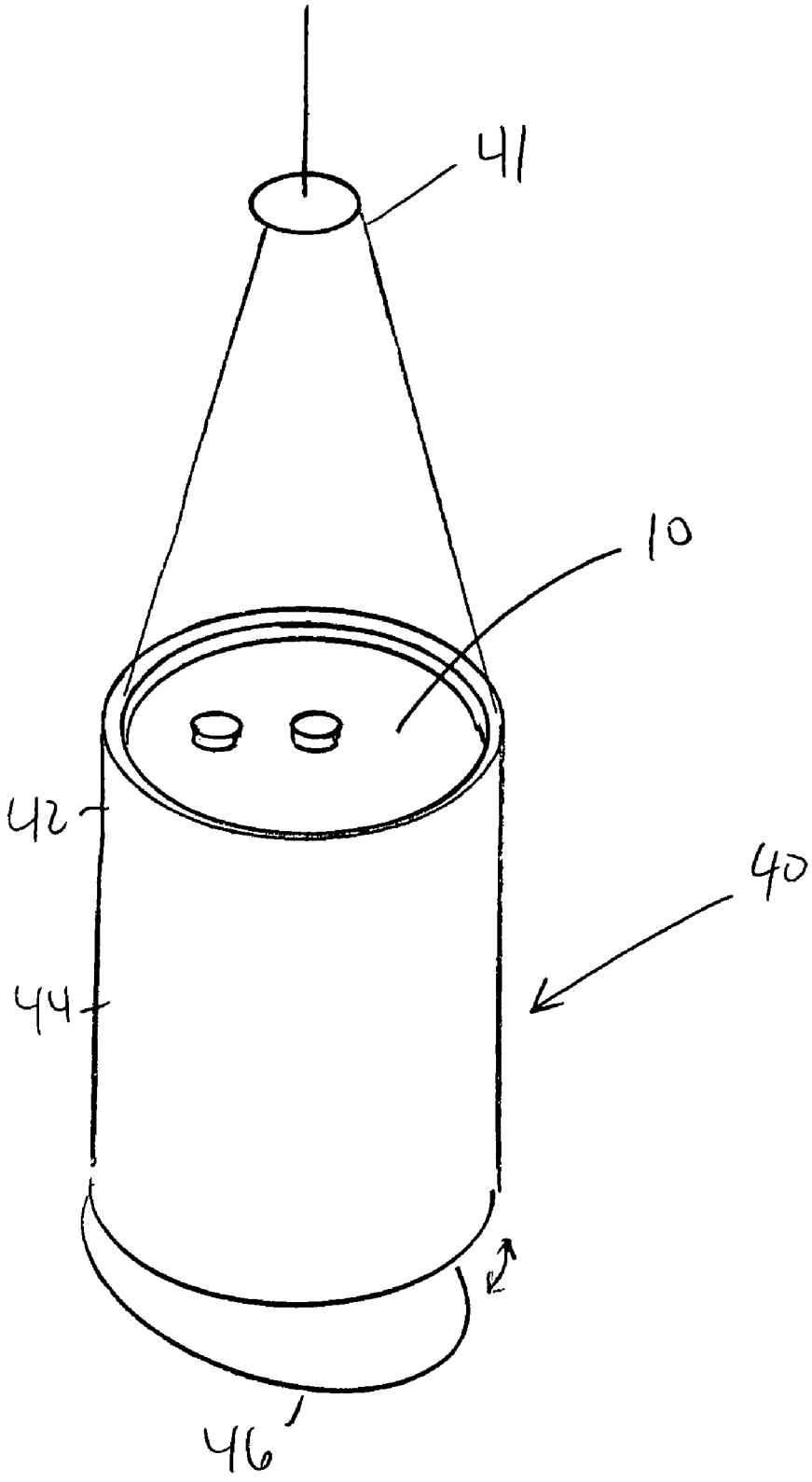
FIG. 3 is a perspective view of the bladder and retainer delivery member for helicopter use.
Figure 4:
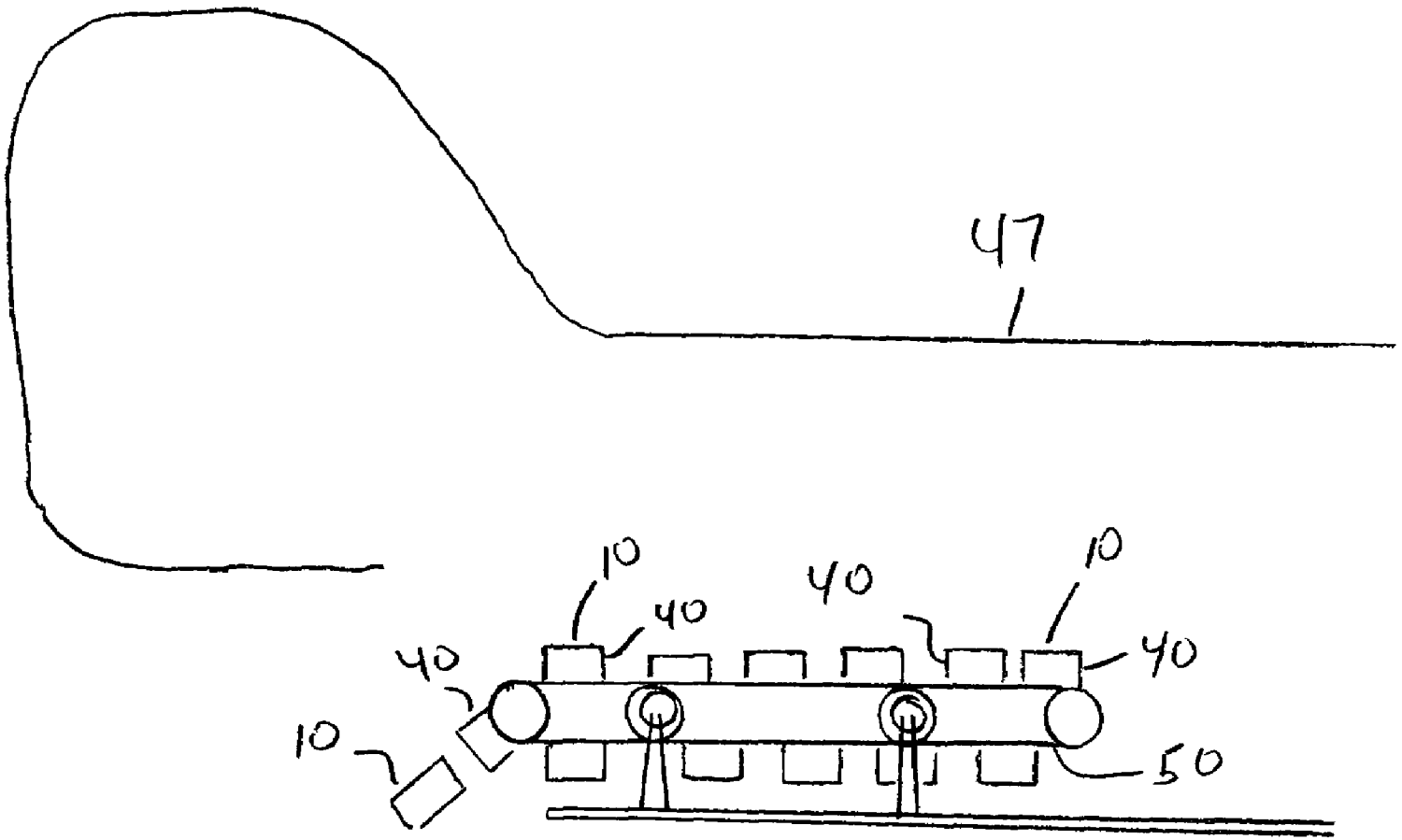
FIG. 4 is a perspective view of a retainer and delivery system of the present invention for containment of a plurality of bladders on an aircraft and the delivery of same.

Due to the desired frangibility of the bladder 10 as constructed, care must be taken that it does not rupture or burst in transport. Therefore a retainer member 40 is utilized to protect the individual bladder 10 during filling and transport to insure that there is no premature rupture or burst. The retainer member 40 would be a cylindrical sleeve 42 having a rigid cylindrical side wall 44 and a rigid circular bottom wall 46. The cylindrical side wall 44 of retainer member 40 would extend upwardly from the bottom wall 46 a sufficient distance such that when a bladder 10 of the present invention were positioned therein, the retainer member cylindrical side wall 44 and bottom wall 46 would provide support to maintain the bladder 10 in the desired orientation. If extended a slight distance above the fill and bleed connectors 26 and 28 in outer top wall 14, the retainer member 40 and secured bladders 10 may be stacked upon each other. A single retainer member 40 of the type described and illustrated in FIG. 3 could be fitted with a harness system 41 and depend from the underside of a helicopter with such retainer member 40 having a release mechanism which would allow the bottom wall 46 to pivot at the desired time so as to release the filled bladder 10 through the bottom of retainer member 40 and onto the desired location in the wild fire.

The same retainer member 40 or plurality of retainer members 40 could be utilized within the body of an aircraft 47 in order to position and release a plurality of bladders 10 of the present invention. Such retainer members could be mounted on a continuous belt 50, or series of continuous belts, each retainer member 40 having a bladder 10 associated therewith, and the belt 50 activated to position a retainer member 40 near the rear ramp of the aircraft, such that the retainer member 40 would initially be moving in a horizontal plane on the retainer belt 50, the belt then passing around a roller and allowing for the bladder 10 to be released from retainer member 40 by inverting the retainer member 40.

The aerodynamics of the bladder 10 could be determined by a series of drop tests such that the pilot of an aircraft would have knowledge of the bladders aerodynamic free fall and in this manner, the pilot would be able to accurately time the release of the bladder 10 so that its aerodynamic free fall would insure delivery of the water or other fire retardant within the bladder to the desired location on the wild fire.

The description of the bladder 10 has been described with respect to a cylindrical bladder, but it will be recognized by those familiar with the art that the shape may be geometrically varied.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. A bladder system for the retention of water or other fire retardant chemical for fighting wild fires or forest fires from an aircraft, the bladder comprising:

a geometrically shaped bladder member having an inner top wall and inner bottom wall and a side wall, outer top wall, and outer bottom wall, there being formed in said inner top wall a connector member for filling said geometrically shaped bladder member with water or a fire retardant chemical and a bleed connector for evacuating air from said geometrically shaped bladder member while said bladder member is being filled through said connector member, said outer top wall, outer bottom wall, and said side wall being formed of a frangible material so as to be burstable or puncturable upon impact when dropped from said aircraft dispersing said water or fire retardant chemicals, a retainer member comprising a rigid sidewall and bottom wall compatible with a shape of a filled geometrically shaped bladder member, said retainer member receiving and supporting said outer bottom wall and said side wall of said geometrically shaped bladder member until said bladder member is dropped from said aircraft by inverting said retainer member, said retainer member adapted to be retained in said aircraft.

2. The bladder system in accordance with claim 1 wherein said inner top wall and said inner bottom wall are semi-rigid and segmented to aid in the frangibility of the geometrically shaped bladder member and the bursting of same.

3. The bladder system in accordance with claim 1 wherein said frangible material is aluminum foil.

4. The bladder system in accordance with claim 1 wherein said frangible material is plastic.

5. The bladder system in accordance with claim 1 wherein said bladder is cylindrical in shape.

* * * * *